US005427566A

United States Patent [19]

Landi et al.

[11] Patent Number: 5,427,566

[45] Date of Patent: Jun. 27, 1995

[54] FLEXIBLE HONEYCOMB PANEL CONTAINING WIRE OR OTHER ABRASIVE MATERIAL

[75] Inventors: Curtis L. Landi; Susan L. Wilson, both of Sunnyvale, Calif.

[73] Assignee: Supracor Systems, Inc., Sunnyvale, Calif.

[21] Appl. No.: 184,570

[22] Filed: Jan. 21, 1994

[51] Int. Cl.[6] ..... B24D 11/00

[52] U.S. Cl. ..... 451/526; 451/495; 451/527; 451/528; 451/529; 451/530; 451/531; 451/532

[58] Field of Search ..... 51/394–400, 51/402, 404, 358, 363, 382, 392; 451/490, 495, 514, 524, 526–532, 534, 536

[56] References Cited

U.S. PATENT DOCUMENTS

| | | | |
|---|---|---|---|
| 3,263,377 | 12/1963 | Charvat | 51/394 |
| 3,491,495 | 1/1970 | Prince | 51/394 |
| 3,623,276 | 11/1971 | Twigg | 51/394 |
| 3,758,393 | 9/1973 | Smith | 51/404 |

*Primary Examiner*—Bruce M. Kisliuk

*Assistant Examiner*—Eileen P. Morgan

*Attorney, Agent, or Firm*—Claude A. S. Hamrick

[57] ABSTRACT

A flexible honeycomb panel containing wire or other abrasive material for abrading a workpiece, including a honeycomb core embedded with a quantity of abrasive material, and a facing sheet. The honeycomb core is formed of undulating strips of resilient thermoplastic material that are thermal compression bonded together to form cell walls defining a plurality of contiguous regularly shaped cells. The abrasive material is contained within the strips. The facing sheet, formed of resilient thermoplastic material, is thermal compression bonded to a face of the core. The bonding is accomplished by simultaneously applying heat and pressure to the joinder of the facing sheet and the core. The opposite face of the core remains uncovered. In use, the uncovered face of the core is brought into rubbing contact with the workpiece. The force imparted by the frictional contact is sufficient to wear down the plastic cell wall material, expose the abrasive material, and cause the material to come into contact with the workpiece with sufficient force to abrade the surface of the workpiece.

14 Claims, 2 Drawing Sheets

FLEXIBLE HONEYCOMB PANEL CONTAINING WIRE OR OTHER ABRASIVE MATERIAL

BACKGROUND TO THE INVENTION

1. Field of the Invention

The present invention relates generally to abrasive devices, and more particularly to an abrasive panel including at least one flexible thermoplastic honeycomb core imbedded with an abrasive material, such as wire or abrasive grit.

2. Description of the Prior Art

There is a need for devices that can shape, sand or smooth the rough or irregular surfaces of materials. In addition, there is a need for devices that can strip or scrape the finish or top coat from the surface of various materials. For example, devices such as sandpaper, steel wool, wire brushes, files etc. are well known in the prior art. These devices are widely used by professional craftsmen and homeowners, having applications in the home, on construction sites, and in numerous business settings.

When working with non flat or irregularly shaped surfaces, such as finely ornamented woodwork and the like, rigid devices such as files and wire brushes are impractical and inefficient to use. Files cannot be used to sand or shape the fine details and intricately curved surfaces that characterize such workpieces. Flexible abrasive devices, such as sandpaper or steel wool, are better suited and more efficiently employed to work on such surfaces.

However, sandpaper, steel wool and the like have many shortcomings and deficiencies that limit their effective use. For example, the paper backing of sandpaper frequently tears during a task thereby reducing the effectiveness of the sandpaper. Steel wool, on the other hand, subjects the hands of the user to the abrasive material characterizing the steel wool; protective measures (e.g. gloves) must be employed to protect the user from the tool he is using.

When flat surfaces are being abraded or polished, either manually or through use of a rotating or vibrating machine, one must usually use some type of rigid or semi-rigid backing for the sandpaper or other flexible abrading material in order to more or less uniformly spread the frictional force over the area of engagement.

In addition, the physical act of scraping, polishing, smoothing, etc. creates jarring forces that shock the muscles in the hands and arms of the user. Sandpaper and steel wool do not have inherent cushioning capability to protect the user's hands and arms.

Thus, there is a great need to provide a device for sanding, polishing, scraping etc. that is flexible and pliable, tear resistant, and is cushioned to protect the hands and arms of the user.

SUMMARY OF THE INVENTION

Objects of this Invention

It is therefore an object of the present invention to provide an abrasive apparatus for sanding, polishing, scraping etc., that is flexible and pliable, resistant to tearing, and cushioned to protect the hands and arms of the user.

It is another object of the present invention to provide an abrasive apparatus having at least one flexible thermoplastic elastomer honeycomb panel.

Another object of the present invention is to provide an abrasive apparatus including at least one flexible thermoplastic elastomer honeycomb panel having an abrasive material contained therein.

Yet another object is to provide an abrasive apparatus that, although flexible, has suitable force spreading characteristics so that a workpiece surface is uniformly abraded.

Briefly, a flexible honeycomb panel containing wire or other abrasive material for sanding, polishing, or scraping etc. a surface of a workpiece, includes a quantity of abrasive material in a panel comprised of a honeycomb core, and a facing sheet. The honeycomb core is formed of undulated strips of resilient thermoplastic material that are thermal compression bonded together to form cell walls defining a plurality of contiguous regularly shaped cells. The abrasive material is contained within the strips. The facing sheet, also formed of resilient thermoplastic material, is thermal compression bonded to a first surface of the core formed by a first extremity of the cell walls. The bonding is accomplished by simultaneously applying heat and pressure to the joinder of the first facing sheet and the core. A second surface of the core, formed by a second extremity of the cell walls remains uncovered. In operation, the second surface of the core is brought into rubbing contact with the workpiece. The force imparted by the contact is sufficient to wear away the cell walls, expose the abrasive material, and cause the material to come into contact with the workpiece with sufficient force so as to abrade the surface of the workpiece.

An important advantage of the present invention is that the thermoplastic elastomer honeycomb panel used in the construction of the apparatus is anisotropic material having improved structural characteristics, tear resistance, and cushioning.

Another advantage of the present invention is that different thermoplastic elastomer honeycomb panel materials may be utilized to maximize the panel firmness, the wear characteristics, the tear resistance and the cushioning characteristics of the apparatus.

Another advantage of the present invention is that different thermoplastic elastomer honeycomb core designs may be utilized to maximize the firmness or flexibility and pliability of the apparatus.

Still another advantage of the present invention is that the core cells may be used to carry a suitable lubricant, polishing compound or other material.

These and other objects and advantages of the present invention will no doubt become apparent to those skilled in the art after having read the following detailed description of the preferred embodiment which is contained in and illustrated by the various drawing figures.

DETAILED DESCRIPTION OF THE EMBODIMENT

Figure 1:
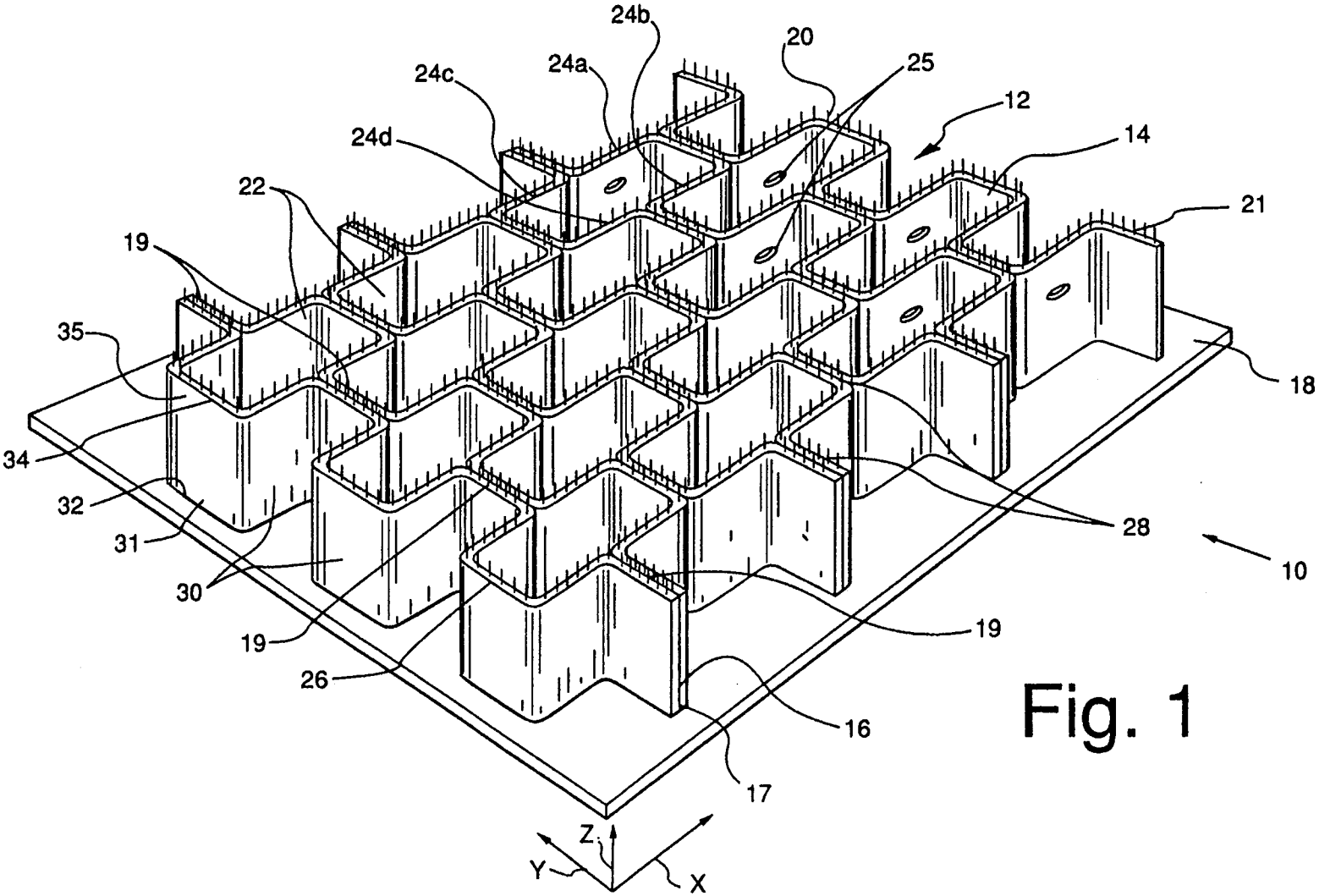
FIG. 1 is a perspective view illustrating an abrasive apparatus, built in accordance with the present invention, having a flexible thermoplastic honeycomb panel with cell walls containing fine gauge wires or fibers.
Figure 2:
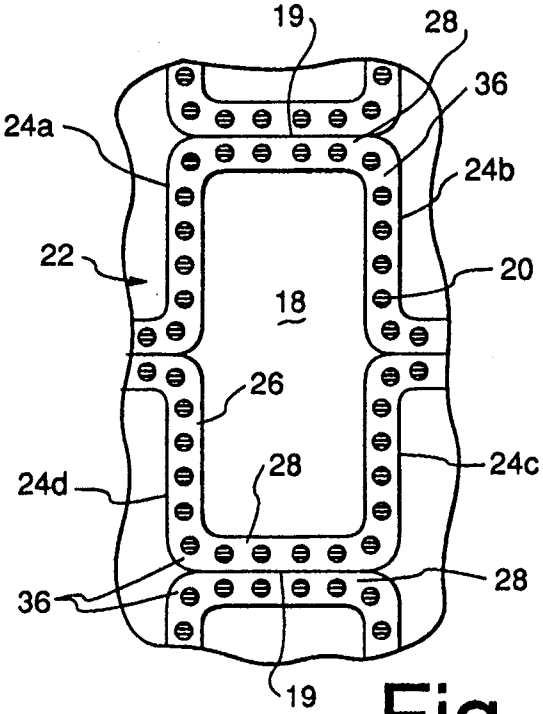
FIG. 2 is a cross-sectional view of a typical cell of the panel illustrated in FIG. 1.

FIG. 1 illustrates at 10 an abrasive panel 12 constructed from flexible thermoplastic honeycomb materials. The panel 12 may be used to abrade (e.g. sand, polish, scrape, etc.) material from the surface of a workpiece (not shown). FIG. 2 is a cross-sectional view of a typical cell of the panel 12. Referring to FIGS. 1 and 2, the panel 12 includes a honeycomb core 14 which is initially made from a stack of ribbons or strips 16 and 17 of a selected grade thermoplastic elastomeric material some of which have been perforated such that a matrix of small holes 25 exist throughout. Although only several strips have been illustrated as perforated it will be appreciated that in some embodiments, none or all of the strips will be perforated. The strips are thermal compression bonded together at spaced intervals staggered between alternate strips, as depicted at 19. When the bonded stack is expanded, this pattern of bonding results in a honeycomb network of generally rectangularly shaped cells 22 (depending on the degree of expansion). The manufacturing and fabrication of the panel 14 is described in greater detail in our U.S. Pat. No. 5,039,567, and incorporated herein by reference.

Each cell 22 of the honeycomb core 14 is defined by four generally S-shaped wall segments 24A, 24B, 24C, 24D, each of which is shared by an adjacent cell. As depicted, the wall segments 24 of each cell 22 include a single thickness wall portion 26 and a double thickness wall portion 28 (including the bond 19).

The core 14 has a lower "face" 32 and an upper "face" 34 either or both of which may be deformed during a planarization operation, as disclosed in our above-identified U.S. Patent, to stabilize the honeycomb core and prevent the expanded strip stack from collapsing. A solid or non-perforated, or even a perforated facing sheet 18, of perhaps heavier gauge resilient thermoplastic material, may be thermocompression bonded to either or both faces.

As will explained in greater detail below, in the preferred embodiment the facing sheet 18 is bonded to only one face, the lower face 32 as depicted in the drawing. The addition of the facing sheet 18 further strengthens the core 14, and provides an ample surface for adhering the panel to a flat or curved surface of a sanding block or other tool. In addition, the facing sheet provides additional cushioning for the user's hands and arms from the jarring forces imparted by the sanding, polishing, or scraping actions. Moreover, where the panel is used without any block or tool, the spacing between the working surface and the user's hand afforded by the core and facing sheet reduces the transfer of heat to the hand.

FIGS. 1 and 2 illustrate one embodiment of the present invention. Abrasive material, which in this embodiment includes fine gauge wire or fiber 20, is mixed into the thermoplastic elastomeric material from which the strips 16 and 17 of the panel 12 are extruded. Each wire or fiber 20 is disposed generally parallel to one another, such that when the strips 16 and 17 are formed into the cell walls 30 of the panel 12, each of the wire or fiber 20 is disposed from the lower extremity 31 of the cell wall to the upper extremity 35 of the cell wall. Since the core plastic will wear faster than the wire or fiber 20, one end of each of the wire or fiber 20 will always extend slightly through the core face corresponding to the uncovered extremity of the cell walls. Since the opposite face of the core is covered by a facing sheet and therefore not exposed to rubbing pressure, the other end of each of the wire or fiber 20 will not normally extend beyond the opposite face. In the embodiment illustrated, an end 21 of each of the wire or fiber 20 extends slightly beyond the upper face 34; the wire 20 does not extend beyond the lower core face 32.

The honeycomb panel is tear resistant and highly resilient, yet extremely lightweight (unfaced honeycomb is approximately 90 percent air). Also, the panel is an anisotropic three-dimensional structure having different degrees of flex along its width (X), length (Y), and thickness (Z) dimensions. In addition, the panel's superior shock absorption and spring-back characteristics result from the use of thermoplastic (or thermoplastic elastomeric materials) for the core and the facing sheet.

Selected combinations of elastomer material and durometer, honeycomb cell configurations, core thickness and facing material variables will determine the panel's characteristics of softness or hardness, resilient recovery rate and rigidity or flex as required for a particular application. Thus, the panel's flexibility can be predetermined by selection of the materials used to construct the core, and by varying the core dimensions and cell sizes. The facing materials can be selected from a wide variety of films, including thermoplastic urethanes, foams, EVAs, elastomer impregnated fibers and fabrics, ceramics, metals, graphites, etc., or combinations thereof.

Although solid or non-perforated cell walls (i.e., a so called solid core structure) and a solid facing sheet have been depicted, an alternative embodiment would entail perforating either or both of the cell wall and/or facing sheet. By perforating either or both of the cell walls and/or facings, the weight of the material 10 is reduced while the resiliency and flexibility is increased. In addition, any effect caused by air entrained in the cells will be reduced where perforated materials are used.

Figure 3:
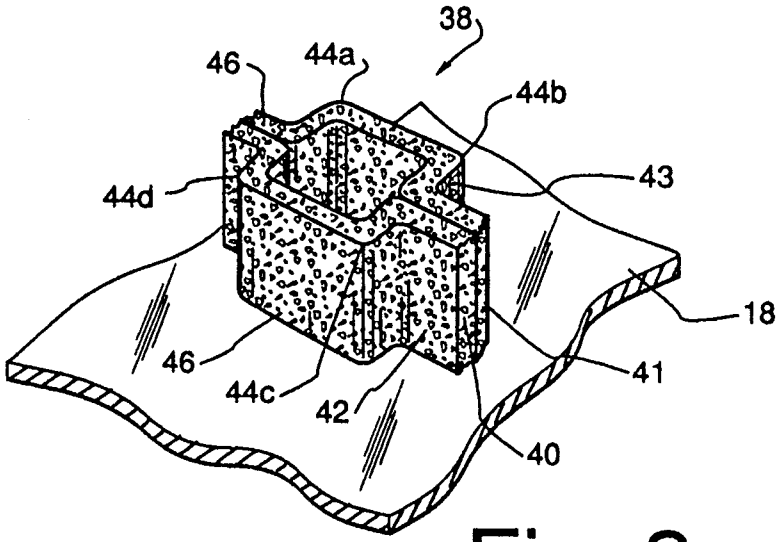
FIG. 3 is a perspective view depicting one cell of an alternative embodiment of the present invention wherein the cell walls of the flexible thermoplastic honeycomb core contain abrasive material.

Referring now to FIG. 3 which illustrates, in perspective view, an alternate embodiment of the present invention. The figure depicts a single typical cell 38 of an alternate honeycomb panel. As described earlier, the cell 38 is formed from bonded together plastic strips 40 and 41 which also form cell walls 42 and 43. As illustrated, the cell 38 includes four generally S-shaped wall segments 44A through 44D. The honeycomb structure is fabricated, in accordance with the manufacturing process described in our earlier referenced patents, from strips 40, 41 which contain abrasive material 46. The material 46 can be selected from a variety of materials such as sand, silica, synthetic diamonds, metallic particles, chopped wire fibers, glass chips and the like.

In use, the non-faced end of the panel is brought into rubbing contact with a surface of a workpiece. The pressure of the rubbing contact is applied by the user of the device and is sufficient to wear away the strips containing the abrasive material. As the surrounding plastic material wears down, abrasive material is exposed and brought into contact with the surface of the workpiece thereby sanding, polishing or removing the workpiece surface material as desired. It will be noted that the plastic strip surrounding the abrasive material must be of a type which will wear slightly faster than the abrasive material so that the encased abrasive material will be exposed so as to engage the workpiece surface.

Figure 4:
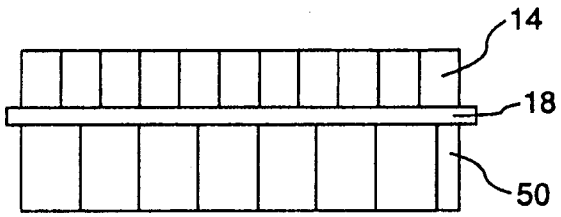
FIG. 4 is a cross-sectional representation of a double cored embodiment of the present invention.

While the preferred embodiment is comprised of abrasive core faced on one side with a facing sheet, it is contemplated that a stabilized but unfaced core may also be useful for some applications. Furthermore, it is anticipated that for some applications the facing sheet may also contain an abrasive so that by turning the panel over a different abrasive characteristic is presented to the workpiece. Alternatively, as depicted in FIG. 4, a second core 50 with the same or different abrasive characteristics as the primary core 14 may be bonded to the opposite face of the facing sheet 18 to provide additional abrading capability.

Although preferred, and alternate embodiments of the present invention have been disclosed above, it will be appreciated that numerous alterations and modifications thereof will no doubt become apparent to those skilled in the art after having read the above disclosures. It is therefore intended that the following claims may be interpreted as covering all such alterations and modifications as fall within the true spirit and scope of the invention.

What is claimed is:

1. An abrasive panel for use in abrading material from a surface of a workpiece, comprising:

(a) at least one honeycomb core formed of undulating strips of resilient thermoplastic material, said strips being thermal compression bonded together to form cell walls defining a plurality of contiguous regularly shaped cells, said strips having abrasive material contained therein; and (b) a facing sheet of resilient thermoplastic material, said facing sheet being thermal compression bonded to a first face of said core formed by a first extremity of said cell walls, the bonding being accomplished by simultaneously applying heat and pressure to a joinder of said facing sheet and said first face of said core, a second face of said core formed by a second extremity of said cell walls being uncovered, whereby during use said second face of said core is brought into rubbing contact with a workpiece surface, the contact being sufficient to wear away said cell walls and expose said abrasive material and cause said abrasive material to come into rubbing contact with the workpiece surface with sufficient force to abrade material from the workpiece surface.

2. An abrasive panel as recited in claim 1 wherein said cell walls of at least some of said cells of said first panel have perforations therein.

3. An abrasive panel as recited in claim 1, wherein said abrasive material includes a plurality of fine gauge wires contained within said cell walls and oriented substantially parallel to each other and normal to a face of said core.

4. An abrasive panel as recited in claim 2, wherein said abrasive material includes a plurality of fine gauge wires contained within said cell walls and oriented substantially parallel to each other and normal to a face of said core.

5. An abrasive panel as recited in claim 1, wherein said abrasive material includes abrasive grit contained within said cell walls.

6. An abrasive panel as recited in claim 2, wherein said abrasive material includes abrasive grit contained within said cell walls.

7. An abrasive panel as recited in claim 1 and further comprising an additional honeycomb core formed of undulating strips of resilient material bonded together to form cell walls, said additional core being bonded to the side of the said facing sheet opposite that to which said one core is bonded.

8. An abrasive panel as recited in claim 7 wherein said additional core is made from a plastic material having abrasive material contained therein.

9. An abrasive panel as recited in claim 8 wherein said additional core has an abrasive characteristic different than that of said one core.

10. An abrasive panel as recited in claim 1 wherein said facing sheet has an abrasive material embedded therein so that the surface opposite that to which said core is bonded may also be used to abrade a workpiece.

11. An abrasive panel comprising:

a honeycomb core formed of strips of abrasive-containing resilient thermoplastic material, said strips being thermal compression bonded together at regularly spaced intervals and expanded to form cell walls defining a plurality of geometrically configured cells; and means for maintaining said core in its expanded configuration so that it can be used to abrade a workpiece surface, said means for maintaining includes a planarized deformation of at least one face of the honeycomb core.

12. An abrasive panel as recited in claim 11 wherein said means for maintaining further includes a sheet of facing material bonded to a face of said honeycomb core.

13. An abrasive panel as recited in claim 12 wherein the abrasive included in said plastic sheet material includes a plurality of wires oriented parallel to each other and normal to a face of said core.

14. An abrasive panel as recited in claim 12 wherein said abrasive included in said plastic sheet material is selected from the group consisting of sand, silica, glass chips, synthetic diamonds, metallic particles and wire fibers.

* * * * *